US006145323A

United States Patent [19]

Popp et al.

[11] Patent Number: 6,145,323

[45] **Date of Patent: *Nov. 14, 2000**

[54] PROCESS AND APPARATUS FOR CRYOGENICALLY CLEANING RESIDUE FROM CONTAINERS

[75] Inventors: James L. Popp; Carolyn Popp, both of 55 Winthrop New Rd., Aurora, Ill. 60506; James Dean, Batavia; Robert E. Clark, Aurora, both of Ill.

[73] Assignees: James L. Popp; Carolyn Popp, both of Aurora, Ill.

[ * ] Notice: This patent is subject to a terminal disclaimer.

[21] Appl. No.: 09/282,474

[22] Filed: Mar. 29, 1999

Related U.S. Application Data

[60] Division of application No. 08/798,842, Feb. 12, 1997, Pat. No. 5,887,750, which is a continuation-in-part of application No. 08/422,547, Apr. 12, 1995, Pat. No. 5,606,860, which is a continuation-in-part of application No. 08/206,731, Mar. 7, 1994, Pat. No. 5,456,085.

[51] Int. Cl.[7] ..... F25D 17/02; B02C 11/08; B08B 7/04

[52] U.S. Cl. ..... 62/64; 62/52.1; 134/17; 220/681; 220/686; 220/378; 241/65; 241/DIG. 37

[58] Field of Search ..... 62/52.1, 64; 241/65, 241/DIG. 37; 220/681, 686, 378; 134/17

[56] References Cited

U.S. PATENT DOCUMENTS

| | | |
|---|---|---|
| 1,492,415 | 4/1924 | Bell . |
| 1,522,630 | 1/1925 | Ireland . |
| 2,609,150 | 9/1952 | Bludeau . |
| 2,735,575 | 2/1956 | Lehman . |
| 2,735,624 | 2/1956 | Beck . |
| 2,907,492 | 10/1959 | Robertson . |
| 2,919,862 | 1/1960 | Beike et al. . |
| 2,951,351 | 9/1960 | Snelling . |
| 3,096,626 | 7/1963 | Morrison . |

(List continued on next page.)

FOREIGN PATENT DOCUMENTS

| | | |
|---|---|---|
| 2359118 | 7/1974 | Germany . |
| 52-1979 | 1/1977 | Japan . |
| 1546142 | 2/1990 | U.S.S.R. . |

OTHER PUBLICATIONS

Draft Text of Drumbeaters Cryo–Cleaner™ Video, 5 pages (undated) *circa* Fall 1993.

Proposal to T.E.K., Inc., see p. 2, *Option B Equipment*: Cryo–Cleaner, 3 pages Mar. 1994.

Operating Instructions, Model Cryo–200–55S, Serial No. 10045, 6 pages (undated) Dec. 1993.

Operating Instructions, Model Cryo–200–555, Serial No. 10052, 9 pages, May 1994.

Boss Bins (Sales Brochure), p. 3, (undated) *circa* 1995.

Thielman, Stainless Steel Aseptic Container with heating or cooling jacket (Sales Brochure) (undated) *circa* 1995.

Uniform Technik Hausach, Containers for Dairy and Fruit Industry (Sales Brochure), (undated) *circa* 1995.

Thielman, Aseptic Container (Sales Brochure), (undated) *circa* 1995.

Thielman, Stainless Steel Containers for Hazardous Products (Sales Brochure), (undated) *circa* 1995.

Columbiana, Stainless Steel High Performance Cylinders/Receptacles (Sales Brochure), (undated) *circa* 1996.

(List continued on next page.)

*Primary Examiner*—Ronald Capossela
*Attorney, Agent, or Firm*—Brinks Hofer Gilson & Lione

[57] ABSTRACT

A method and apparatus for the cleaning of residue from the surface of a container where the method comprises cooling the container and residue adhered to the container surface to a low temperature, substantially embrittling the residue, fragmenting the residue, separating the residue from the surface of the container and removing the residue from the container. The container is placed in an enclosure with an opening in the top of the enclosure to permit access to the interior of the container when a container lid is removed. The system includes a rotating base to turn the container to facilitate freezing and removal of the residue.

20 Claims, 6 Drawing Sheets

U.S. PATENT DOCUMENTS

| | | | |
|---|---|---|---|
| 3,101,757 | 8/1963 | Hanson . | |
| 3,244,312 | 4/1966 | Lawson . | |
| 3,255,597 | 6/1966 | Carter, Jr. . | |
| 3,316,726 | 5/1967 | Pauliukonis . | |
| 3,614,001 | 10/1971 | Beike . | |
| 3,643,873 | 2/1972 | George . | |
| 3,666,185 | 5/1972 | Williams . | |
| 3,771,729 | 11/1973 | Frable . | |
| 3,878,787 | 4/1975 | Lightstone et al. . | |
| 3,914,953 | 10/1975 | Miller . | |
| 3,934,379 | 1/1976 | Braton et al. . | |
| 4,043,019 | 8/1977 | Schroder . | |
| 4,073,443 | 2/1978 | Danioni . | |
| 4,084,387 | 4/1978 | Schorsch et al. . | |
| 4,124,997 | 11/1978 | Sadjina et al. . | |
| 4,175,396 | 11/1979 | Miller et al. . | |
| 4,267,940 | 5/1981 | Wade . | |
| 4,273,294 | 6/1981 | Hollely et al. . | |
| 4,304,105 | 12/1981 | West . | |
| 4,342,647 | 8/1982 | McMillan et al. . | |
| 4,409,034 | 10/1983 | Williams . | |
| 4,411,372 | 10/1983 | Basterfield et al. . | |
| 4,483,488 | 11/1984 | Luff et al. . | |
| 4,491,484 | 1/1985 | Williams . | |
| 4,531,382 | 7/1985 | Butler et al. . | |
| 4,554,025 | 11/1985 | Burke et al. . | |
| 4,589,203 | 5/1986 | Le Diouron . | |
| 4,627,197 | 12/1986 | Klee et al. . | |
| 4,692,982 | 9/1987 | Rice . | |
| 4,705,574 | 11/1987 | Burckhardt et al. . | |
| 4,739,625 | 4/1988 | Buchmuller et al. . | |
| 4,768,535 | 9/1988 | Marx et al. . | |
| 4,991,402 | 2/1991 | Saia, III | 62/52.1 |
| 5,011,087 | 4/1991 | Richardson et al. . | |
| 5,025,632 | 6/1991 | Spritzer . | |
| 5,044,129 | 9/1991 | Olevitch . | |
| 5,072,851 | 12/1991 | Wilkes . | |
| 5,094,696 | 3/1992 | Orsen . | |
| 5,203,511 | 4/1993 | Ondush et al. . | |
| 5,271,234 | 12/1993 | Carter et al. . | |
| 5,385,233 | 1/1995 | McKibben et al. . | |
| 5,475,984 | 12/1995 | Fermani et al. | 62/64 |
| 5,478,584 | 12/1995 | Donohue et al. . | |
| 5,509,277 | 4/1996 | Kiczek et al. . | |
| 5,509,278 | 4/1996 | Kiczek et al. . | |

OTHER PUBLICATIONS

21st Century Containers, Ltd., Atlas 275 (Sales Brochure), (undated) *circa* 1995.

James Atkinson & Co., Ltd., PTC1200 Portable Tank Container (Sales Brochure), (undated) *circa* 1995.

Anderson Columbiana Trading, Easier Ways To Ship Difficult Chemicals and Gases (Sales Brochure), pp. 2–3, (undated) *circa* 1995.

BSi, A Complete Range of Small Tank Containers for Liquid and Gas (Sales Brochure), (undated) *circa* 1995.

Fabricated Metals, Inc., FLO–BIN, LIQUA–BIN (Sales brochure), pp. 1–2, (undated) *circa* 1995.

Eco–Pak, Inc., Eco–Pak (Sales Brochure), pp. 1–3, (undated) *circa* 1995.

Tank World and IBCs Today, Jan./Feb. 1996, pp. 13 and 19.

McGraw–Hill Encyclopedia of Science & Technology, vol. 4, pp. 542–551 (6th ed., 1987).

Cryo–Smasher™ Brochure, by Drumbeaters of America, 2 pages (undated) *circa* 1993.

Letter to Doug Baldwin, Sherwin Williams, 9 pages, Dec. 1993.

20
22
24
26
28
30
32
34
36
38
40
42
44

PROCESS AND APPARATUS FOR CRYOGENICALLY CLEANING RESIDUE FROM CONTAINERS

CROSS-REFERENCE OF RELATED APPLICATIONS

This application is a division of application Ser. No. 08/798,842, filed Feb. 12, 1997, now issued as U.S. Pat. No. 5,887,750, which is a continuation-in-part of application Ser. No. 08/422,547, filed Apr. 12, 1995, now issued as U.S. Pat. No. 5,606,860, which is a continuation-in-part of application Ser. No. 08/206,731, filed Mar. 7, 1994, now issued as U.S. Pat. No. 5,456,085.

BACKGROUND OF THE INVENTION

The present invention generally relates to the removal of residual materials from containers for disposal or recycling. More specifically, the present invention relates to a method and apparatus for cleaning residues from the surface of containers by the use of low temperatures. In addition, the present invention relates to a container with features that facilitate cleaning by the use of low temperatures.

The disposal of wastes has become a great concern due to the environmental problems associated with hazardous materials. Of even more immediate concern are the economic problems associated with rising costs and reduced capacity of landfills, as well as the tighter governmental regulations concerning waste generators, air pollution, employee safety and fire prevention. Consequently, disposal of containers and the residual materials remaining therein can be a costly and time consuming endeavor. Emphasis has been placed on cleaning the residues from the containers so that only the residues, and not the containers, are subject to costly hazardous waste disposal. This leaves the containers available to be reused, recycled, or disposed of in a less expensive non-hazardous waste landfill.

One benefit of using an intermediate bulk container (IBC) is the ability to reuse the containers. IBCs range in size from 85 gallons to 550 gallons and come in a variety of shapes and are fabricated using a variety of materials, such as plastic, aluminum, steel and stainless steel. In order to reuse an IBC, the container must first be cleaned. Often the product being shipped in the IBC is viscous, sticky and/or hazardous. Sometimes the residue sets up after exposure to moisture or water, or expands in volume as the result of the cleaning agent. Further, cleaning these containers has been made more difficult as a result of new and ever changing EPA, OSHA and local fire regulations and zoning laws.

The U.S. government has established guidelines under the Resource Conservation and Recovery Act (RCRA) that specify the cleanliness requirements for disposal of containers as non-hazardous waste. Nevertheless, some states are imposing bans on the disposal of even clean containers in landfills as a remedy for rapidly diminishing landfill capacity. This leaves reuse or recycling of the containers as the only alternative.

A broad range of residues of expended commodities are subject to costly hazardous waste disposal. Some of these residues include, but are not limited to tars, lubricants, mastics, inks, coatings, solvents, adhesives, sealants, paints, etc. A range of traditional cleaning methods exists to remove such residues from commodity containers. These methods include applying water, steam, soaps, detergents, chemical solvents, abrasives and scrubbing equipment. All of these methods result in an increased volume of waste being created that may be more difficult to dispose of than the original residue. These methods may be costly due to the need of expensive materials, equipment and intensive labor. Even if the residue is not considered hazardous, there may be restrictions imposed by municipal sewage districts that require expensive pre-treatment before the residue and wash liquid may be discharged into the sewage drains.

Typically solvents, caustics and various soaps or detergents have been used to clean various containers including IBCs. What kind of cleaning agent is use is dependent on the type of residue being removed from the container. No matter what cleaning agent is used, the amount of the waste stream is always increased and the removed residue is commingled with the cleaning agent. This approach results in, but is not limited to, an increase in disposal costs, a residue that cannot easily and economically be recycled, potential health hazards for employees, emissions of volatile organic compounds (V.O.C.s) into the atmosphere, and potential environmental liability. Further, some cleaning techniques such as sand, bead or soda blast cause damage to the metal by pitting and thinning of the IBC walls.

As an example of traditional cleaning methods, chemical solvent based cleaning involves numerous disadvantages. The solvents are expensive. They require special care and handling because of their combustibility, corrosiveness and/or volatility. Special ventilation equipment may be required to recover the volatile organic compounds which vaporize during use. Additional equipment may be needed to separate the solvent from the residue waste wash for recycling of the solvent. If not separated, the volume of the waste product is greatly increased. Employees require additional training to safely handle the equipment and materials. Special inspections, building codes and zoning requirements may be difficult to comply with, or require that special facilities be constructed for the cleaning equipment. In the end, most small organizations do not have the resources to properly handle the problems associated with disposing or recycling residue laden containers using traditional methods.

There exists a sizable gap between existing traditional cleaning methods to remove residue from containers and the requirements of industry to clean containers with a cost effective, environmentally safe process. Therefore, there exists the need for a method and apparatus for cleaning residues from containers that does not have the inefficiencies, hazards and environmental liabilities associated with traditional cleaning methods.

In particular, large commodity containers are heavy and difficult to maneuver because of their size. Many have very small openings which makes removal of residue difficult. Therefore, there is a need for new containers that facilitate residue removal low temperature methods of cleaning. Likewise, there is a need for new apparatus to complement these new containers and allow the use of new methods of low temperature cleaning.

SUMMARY OF THE INVENTION

Accordingly, the present invention is directed to provide a simple, cost effective, environmentally safe method and apparatus for the cleaning of residues of expended commodities from the inside surfaces of commodity containers. In an aspect of the invention, the method involves cooling the residue-laden container to a temperature where the residue becomes embrittled, fragmenting the residue, separating the residue from the surface of the container and removing the residue. Preferably, the container is cooled by placing it in an insulated chamber and contacting it with a cold cryogen. More preferably, the container lid is removed and the residue is removed while the container is in the insulated chamber facilitated by the container extending through an opening in the top of the insulated chamber.

Another aspect of the invention provides an insulated chamber with an opening in the top sufficiently large to allow a container to extend therethrough, gasketing to seal the opening against the container, a base for supporting the container, a plurality of cryogen sprayers located on a chamber wall and in the base. Preferably, the base rotates so that the cryogen sprayers may be located on one portion of the wall but obtain sufficient coverage of the container as it rotates past the sprayers.

In yet another aspect of the invention, a container is provided that facilitates being cleaned by the method and apparatus of this invention. The container has a cylindrical body, a removable lid, a sealing gasket between the body and lid and a retaining ring holding the lid to the body. In detail, the body has an opening at the upper end substantially the full width of the container, the upper end has a flange that extends outwardly and an inner sealing ring that extends upwardly above the height of the flange. The lid has a side wall that extends downward and terminates with an outwardly extending flange that is positioned proximate to the body flange when the lid is placed on the body, and the side wall is proximate to the inner sealing ring of the body. The container also includes a sealing gasket disposed in the channel defined by the inner sealing skirt, the body flange and the lid flange, and includes a retaining ring surrounding the body flange and lid flange to apply a force against the body flange and lid flange for sealing against the gasket.

The preferred embodiments of the invention avoid the use of solvents and other wash liquids so that the hazardous material for disposal is limited to the original residue itself. These embodiments also require less equipment and less labor to operate than traditional methods of cleaning and reduces health risks to the operating personnel. The preferred embodiments substantially remove the residues from the container to meet U.S. government disposal requirements and industry requirements for re-use of the container. Further advantages of the present invention will be apparent from the accompanying drawings and the detailed description of the invention.

DETAILED DESCRIPTION OF THE DRAWINGS AND PRESENTLY PREFERRED EMBODIMENTS

Figures 1, 2, 3:
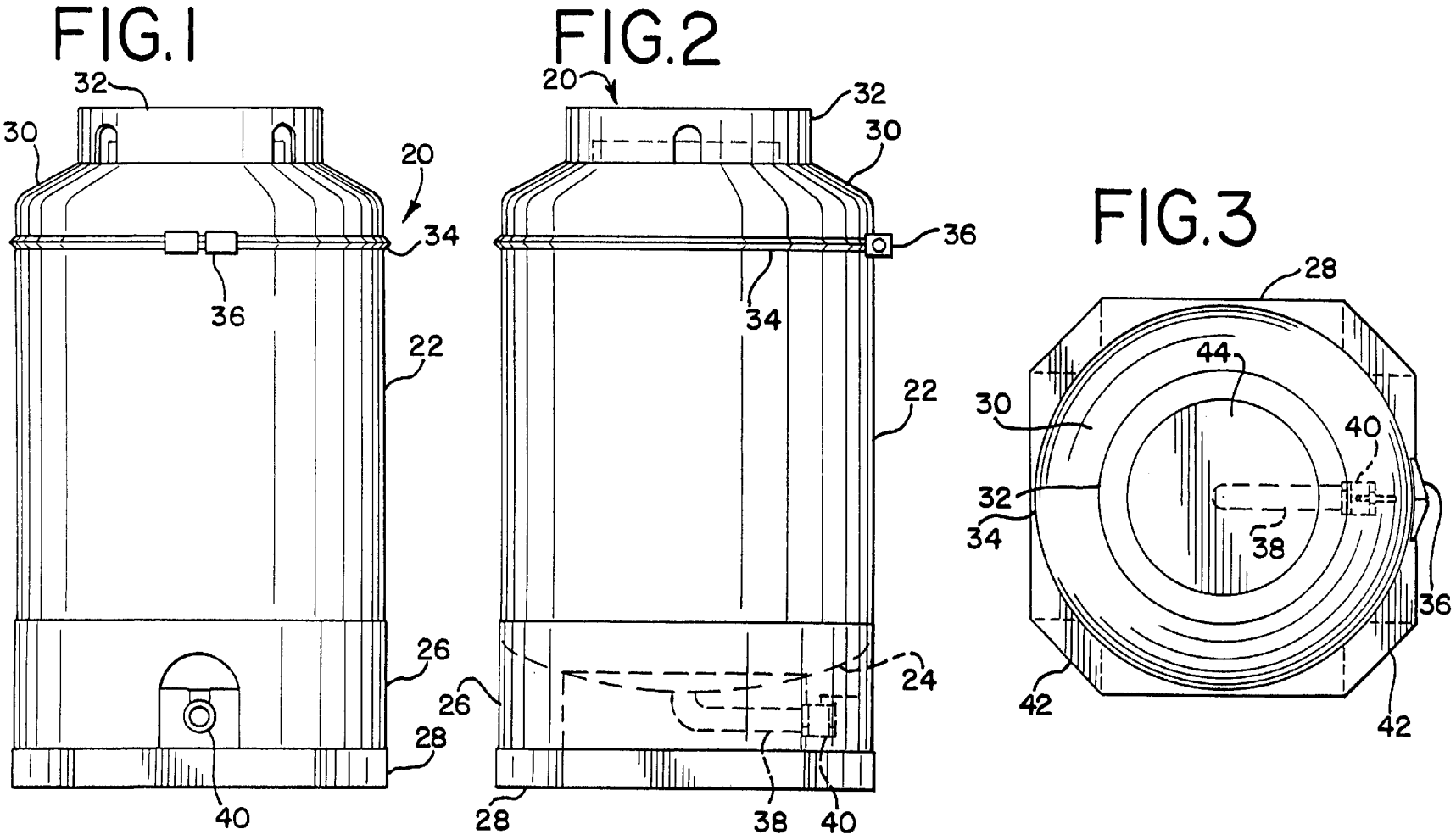
FIG. 1 is a front plan view of one embodiment of the container of the present invention.
FIG. 2 is an side plan view of the container of FIG. 1 showing the bottom outlet pipe detail.
FIG. 3 is a top plan view of the container of FIG. 1 showing the bottom outlet pipe detail.

A preferred embodiment of the intermediate bulk container adapted to facilitate cryogenic cleaning of residue therein is depicted in FIGS. 1 through 11. As shown in FIGS. 1 and 2, the intermediate bulk container 20 includes a cylindrical body 22 with a rounded dish bottom 24 and a support skirt 26 attached to a base 28. The container also includes a lid 30 with a guard ring 32 on top. Holding the lid 30 to the body 22 is a retaining ring 34 held together with a clevis fastener 36. At the bottom of the container, an outlet pipe 38 and discharge valve 40 may be included for containers designed for carrying liquids or highly viscous materials.

Preferably, the container has two major parts: the lid and the body/bottom/base unit which are held together with the retaining ring 34. The container may also be constructed with other separable configurations such as where there are three separable units: a lid, a body, and a bottom dish/base unit which are held together by two sets of retaining rings. Regardless the configuration chosen, it is preferred that the container be constructed from carbon steel, aluminum or stainless steel. The interior surfaces of the container shall preferably be a highly polished surface, preferably using an electro-polish method.

As may be seen in FIG. 3, the base has cut away corners 42 to permit four-way access to fork lifts. This preferred construction may be seen in greater detail in FIG. 11. Referring back to FIG. 3, a man hole and cover 44 may be provided on the lid 30 for easy access to the container interior for loading commodity materials, or for interior inspection of the container.

Figure 4:
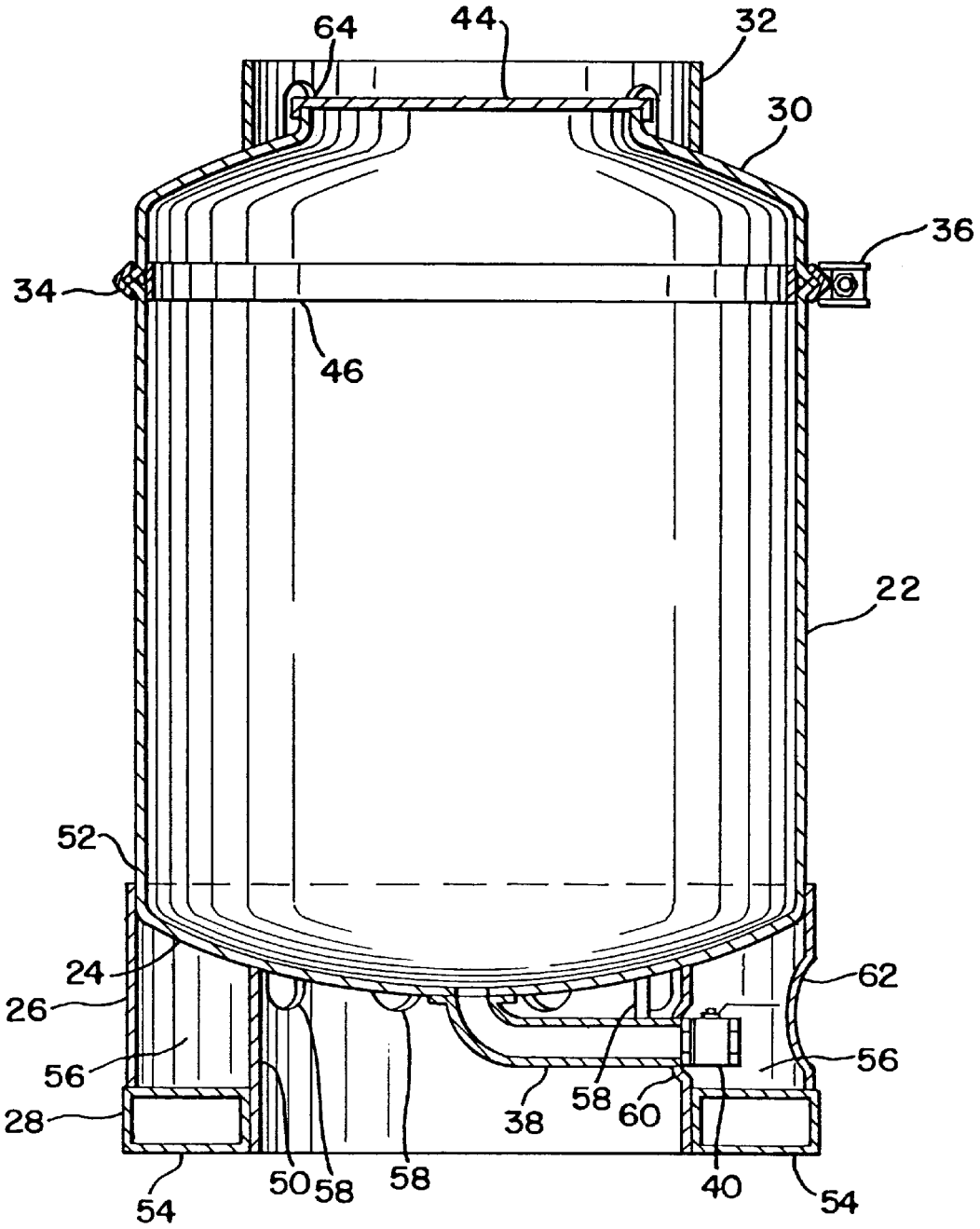
FIG. 4 is a side cross-sectional view of the container of FIG. 1.

As shown in cross-section detail in FIG. 4, the container has numerous features not found in other IBCs. The container opens by a lid 30 that spans the full width of the container body 22. At the junction between the lid 30 and body 22, an inner sealing band 46 is provided that extends above the container body 22 and not only helps to limit material from leaking out of the container, but during cleaning with the lid off, the sealing band 46 also protects the body flange 48 (FIG. 5) from destructive forces from cleaning equipment.

The lid 30 is preferably a rounded-dish shape for structural strength and complete drainage of contents. The exact rounded shape may vary and include, but is not limited to, a standard elliptical head. However, a flat top may also be used with the corresponding decrease in structural strength.

Likewise, the container bottom 24 is preferably a rounded-dish shape for structural strength. The exact shape may vary and include, but is not limited to, an elliptical head or even a hemispherical head. A rounded-dish shape provides a low point in the center where an outlet pipe 38 may be connected.

Continuing to refer to FIG. 4, at the bottom of the cylindrical container there are a cylindrical outer support skirt 26 and a cylindrical inner support skirt 50. The outer skirt 26 depends from the outside lower end 52 of the container cylindrical body 22 and connects to the base 28, which is shown in greater detail in FIG. 10. The inner support skirt 50 depends from the underside of the bottom dish 24 and connects to the base 28 on the inside of the fork lift pockets 54. The inside of the inner support skirt 50 is completely open through the bottom of the base 28 to permit spraying of cryogen directly on the bottom of the container. The inner support skirt 50 is concentric with the outer support skirt 26 forming an annular space 56 between the two skirts. A plurality of scallop openings 58 are provided in the inner support skirt spaced around the circumference of the skirt located where the skirt 50 joins the bottom dish 24. An opening 60 is also provided in the inner skirt 50 to permit the outlet pipe 38 to pass from the center low point of the container to the annular space 56 where a discharge valve 40 is threaded to the end of the outlet pipe. An opening 62 is provided in the outer skirt to permit access to the discharge valve 40.

With the inner support skirt 50 being cylindrical and open at the base, the containers may be securely stacked. To this end, the lid guard ring 32 would need to be slightly smaller in diameter than the inner support skirt 50. With these relative dimensions, the lid ring 32 of the lower container would just fit inside of the inner skirt 50 of a container stacked on top.

Many IBCs in the marketplace have lids that are merely manhole covers in the top of the container and restrict full access to the interior of the container. However, there are existing round IBCs in the marketplace that have covers/lids that can be removed to expose the entire full diameter of the interior of the IBC tank. These IBCs were designed and manufactured prior to the new UN/DOT standards that went into effect Oct. 1, 1996. With the new standards, the existing round top IBC designs with the fully removable lid no longer meet the new UN/DOT standards that require IBCs to pass hydrostatic testing at pressures of 29.5 psig for 10 minutes. Typical IBCs range in size from 275 to 350 gallons and have large diameters. A round IBC with an inside diameter of 44 inches and a matching 44 inch diameter lid/cover is subject to a force of 22.4 tons against the lid under the testing conditions. This tremendous force requires a new technique for joining and holding together the lid to the body of the container.

Figure 6:
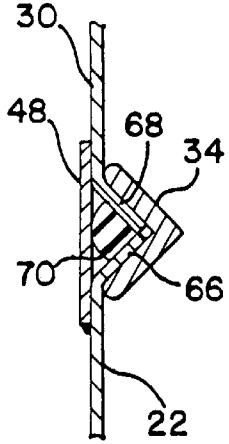
FIG. 6 is an enlarged side cross-sectional view showing the detail of the body and lid flanges and retaining ring of FIG. 5 in a closed position.
Figure 5:
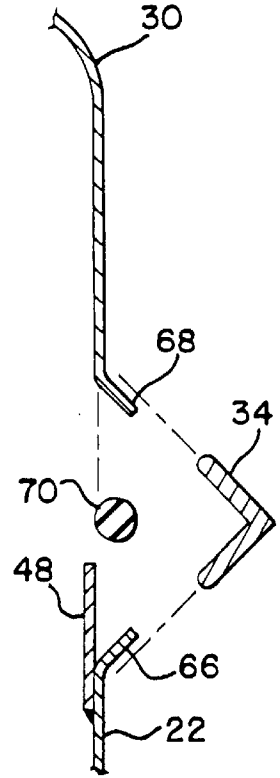
FIG. 5 is an enlarged exploded side cross-sectional view of FIG. 4 showing the detail of the body and lid flanges and retaining ring.
Figures 10, 11, 12:
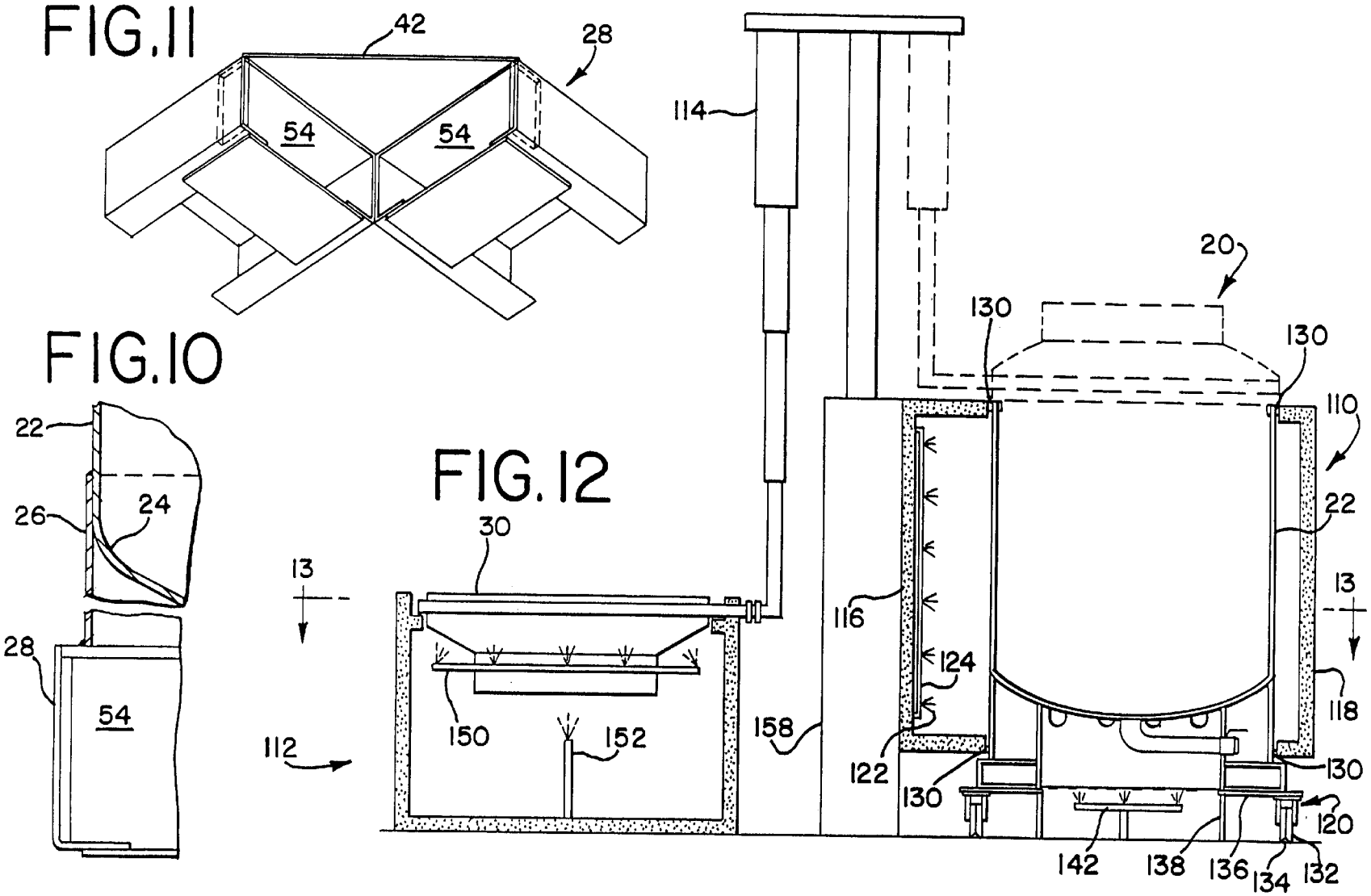
FIG. 10 is an enlarged cross-sectional view of the container support skirt and base.
FIG. 11 is an enlarged bottom perspective view taken of a corner of the base showing the fork lift pocket entry way.
FIG. 12 is a side cross-sectional view of a dual cryogenic container treatment chamber system showing an open container and lid in the dual chambers.

As shown in detail in FIGS. 5 and 6, the lid 30 and container body 22 join together in a unique configuration. The top of the body 22 ends in an outwardly extending flange that forms an acute angle with the sealing band 48. Preferably the angle is about 45 degrees. The sealing band 48 is welded to the inside wall of the body 22 below the flange 66 and extends upwards above the height of the flange 66. The sealing band preferably extends as far above the flange 66 as it does below to ensure adequate overlap with both the body 22 and the lid 30.

In the lid, the bottom of the lid ends with an outwardly extending flange 68 that forms an acute angle with the sealing band 48 when the lid is positioned on the body 22. Preferably that angle is 45 degrees, and corresponds to the angle of the body flange. The sealing band 48 overlaps the inside surface of the lid so that internal pressures force the sealing band against the lid to minimize the pressures seen at the gasket 70.

When the lid 30 is placed on the body, the lid flange 68 comes down to rest next to the body flange 66. A gasket 70 is placed in the channel defined by the flanges 66 and 68 and sealing band 48. The gasket material is compressed by the flanges to seal the lid/body junction. Preferably the gasket is an O-ring that is made from 40 durometer EPDM. A light film of lubricant may be placed on the flange surfaces to provide better seal against the gasket 70.

To hold the lid and body together, a retaining ring 34 is placed around the entire perimeter of the container against both the lid flange 68 and body flange 66. Preferably, the retaining ring is rolled hoop made from angle iron. The inside angle is placed against the lid and body flanges. Preferably the flanges extend outwardly at a degree that mates with the inside angle of the rolled hoop. The retaining ring is tightened around the container to further compress the lid to the body and obtain a tighter seal against the gasket 70. Accordingly, it is desirable that the gasket 70 be sufficiently large and durable to support the lid and keep the flanges slightly apart before the retaining ring 34 is installed. A light film of lubricant may be used to help the exterior flange surfaces slide across the interior surface of the retaining ring as the retaining ring is tightened. The retaining ring clamps down on the flanges and further compresses the gasket. The retaining ring could also be a chain or cable or other strong mechanical device to obtain the same effects. Preferably, the retaining ring is a single piece that has a single opening with a single fastener. However, the ring could also be made from several pieces with several fasteners used to assemble it together, which would, of course, require additional labor to install.

Figure 7:
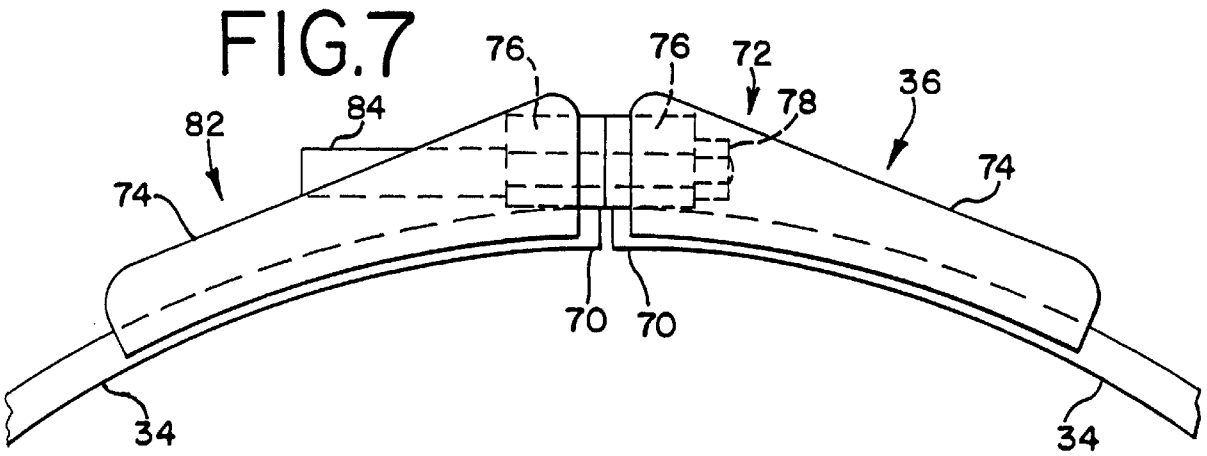
FIG. 7 is an enlarged top plan view of a clevis fastener on the retaining ring when installed on a container.
Figure 8:
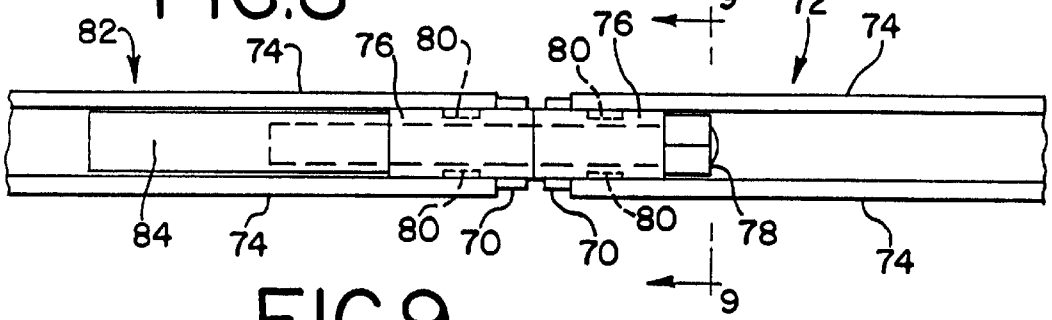
FIG. 8 is a side plan view of the clevis fastener of FIG. 7 when installed on a container.
Figure 9:
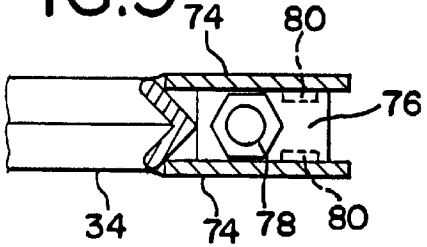
FIG. 9 is a cross-sectional view of the clevis fastener of FIG. 8 taken along line 9—9.

As shown in FIGS. 7, 8 and 9, the retaining ring clevis fastener 36 is designed to keep the ends of the retaining ring together to avoid the ring from deforming inward and denting the container, or relieving the inside pressure. Preferably, all components of the clevis fastener are made from 304 stainless steel. The clevis fastener 36 is made in two complementary parts at each joining end 70 of the retaining ring 34. On the bolt head side 72, two parallel gusset plates 74 are joined along the outside edges of the retaining ring 34 beginning behind the ring end 70. Between the gusset plates 74 is a clevis block 76 that extends beyond the gussets and slightly beyond the retaining ring end 70. The block 76 may be held in position by plug welds 80 through the side of the gussets 74. Of course, other means may be used to hold the blocks 76 in place, and welds may be used throughout the fastener to secure other components together. The block 76 has a bore for a bolt 78 that has a hex head that fits snugly between the gussets to prevent the bolt from turning.

On the nut side 82 of the fastener, a clevis block is similarly positioned between the gussets 74 and held in place with plug welds 80. This clevis block also extends beyond the end 70 of the retaining ring. With this configuration, when the bolt 78 is placed through the blocks 76 and tightened with a socket drive nut 84, both the bolt side 72 and nut side 82 of the clevis fastener come together until the clevis blocks 76 butt together. The butted clevis blocks 76 prevent the retaining ring from bending inward from the outward expansive forces inside the container due to any internal pressure. Accordingly, the retaining ring must be sized accurately for the specific circumference of the container.

The cylindrical shape of this container is advantageous for cryogenic cleaning. Smooth round walls are easier to clean, scrape or brush. Square corners are more laborious and accumulate greater residue. Also, a cylindrical shape requires less weld lines, which in turn means less potential of suffering thermal shock from the freeze/thaw cycles during cryogenic cleaning. The round shape can uniformly expand and contract, distributing the forces. On the other hand, it is believed that a square tank unevenly distributes the thermal shock concentrating it in the corners leading to early weld failure.

Moreover, with the cylindrical shape, round dish bottoms and lids may be easily used to provide further structural strength to the container, both during cleaning freeze/thaw cycles and during shipment with full loads. The rounded dish bottom allows easy drainage of the contents, but other shape bottoms may be used. The full diameter lid provides easy access to the interior for cleaning, in comparison to containers that have small manhole type covers.

Further, cylindrical support skirts also provide greater strength by distributing forces around the entire perimeter of the container. Conventional tanks are supported with four legs that concentrate shocks from falls and short drops where the legs join the tank bottoms, often causing deformation of the tanks at that junction. With this design, the tank passed a drop test loaded to a gross weight of 6500 pounds.

These advantages can be better appreciated by a description of the cryogenic cleaning system designed for cleaning such larger size intermediate bulk containers.

Figure 13:
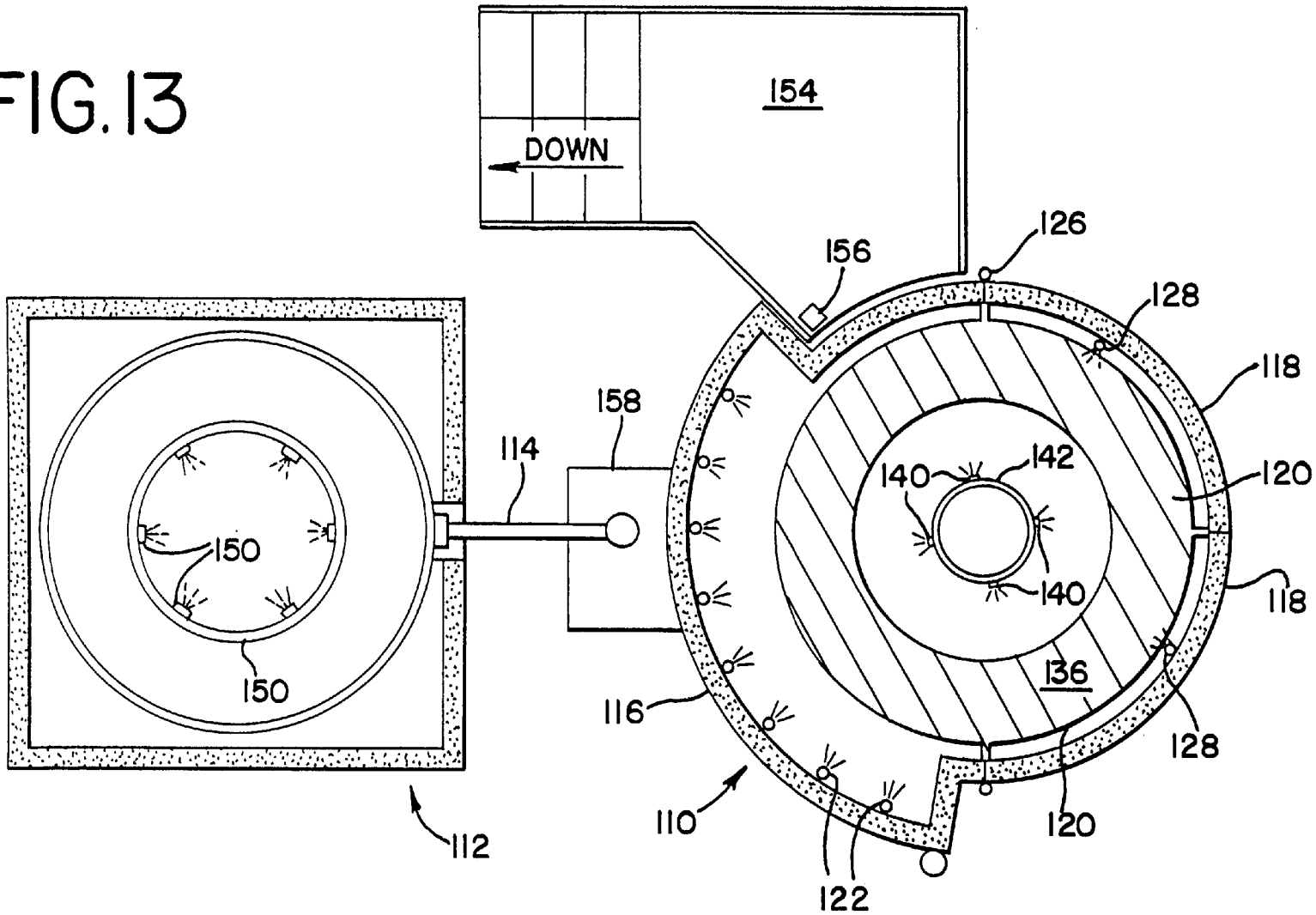
FIG. 13 is a top cross-sectional view taken along line 13—13 of FIG. 12 showing the details of the dual cryogenic container treatment chamber system without a container and lid in the chambers.

A preferred embodiment of the system used to cryogenically clean residue from an IBC, such as the preferred embodiment described above, is depicted in FIGS. 12 and 13. The system includes two insulated chambers. A large chamber 110 is used for cleaning the containers. A smaller chamber 112 is used for cleaning the container lids. A mechanical lift/arm 114 is provided to assist with the lid removal and replacement between the container in the large chamber 110 and the lid cleaning chamber 112. The chambers are preferably made from metallic skins with several inches of insulation in-between. The metal may be mild steel, aluminum or stainless steel. Of course, non-insulated chambers may be used. However, the thermal inefficiency and waste of cryogen would not be as economical as using insulated chambers.

The large chamber 110 for the containers is preferably shaped to minimize the space surrounding the container. Accordingly, for a round container, a round chamber would be suitable. As can be more easily seen in FIG. 13, the chamber 110 includes a recessed cryogen spray section 116, hinged access doors 118 for placing and removing the containers, and a rotating base 120. The cryogen spray section 116 is recessed to allow the cryogen spray to disperse and contact a greater area of the container. Also, the recessed area provides more volume for the expansion of the cryogen gas. A plurality of spray ports 122 on vertical cryogen manifolds 124 are located in this section. The manifolds 124 may be copper stainless steel tubing, for example, and the ports 122 may be holes in the tubing or cryogen spray nozzles threaded onto the manifold. This spray section 116 preferably covers about one-third the circumference of a container in the chamber 110.

The chamber doors 118 open about 180 degrees of the chamber to permit containers to be easily placed inside and maintain small clearance between the doors and the container after the doors are closed. Hinges 126 located on the exterior of door allow the full opening of the doors. Optionally, spray ports 128 may be provided on the interior of the doors. The doors close around the container like a jacket. Compression seals 130 are located at the top and bottom of the door to seal against the container. The compression seals 130 are also found on the rest of the chamber openings that contact the container. The compression seals may be made of mylar, kevlar or silicone. It is believed that any commercially available seals designed for cryogenic applications may be used. Preferably, the compression seals will allow a modest 1 or 2 psig pressure build-up inside the chamber. A pressure release system may be provided to vent any excess pressures from the chamber.

Figure 15:
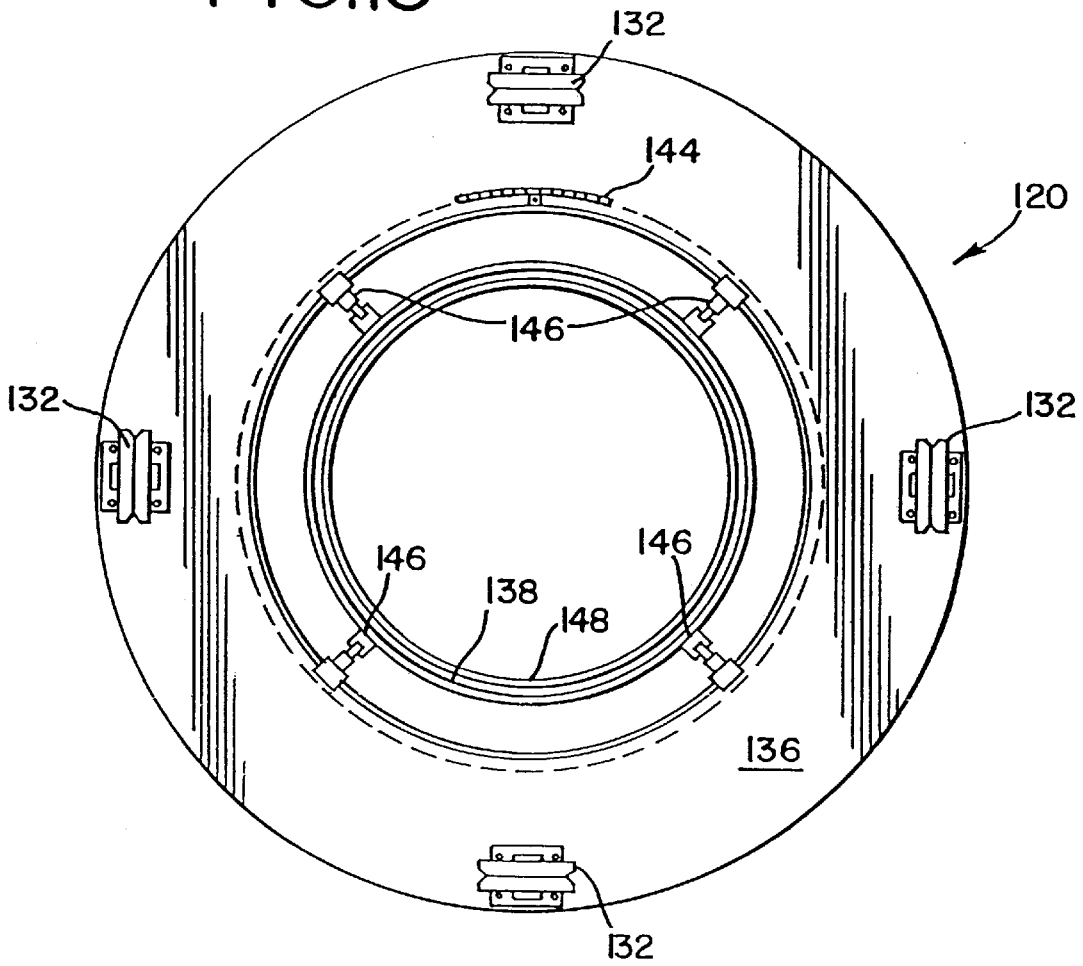
FIG. 15 is a bottom plan view of the chamber base of FIG. 14.
Figure 14:
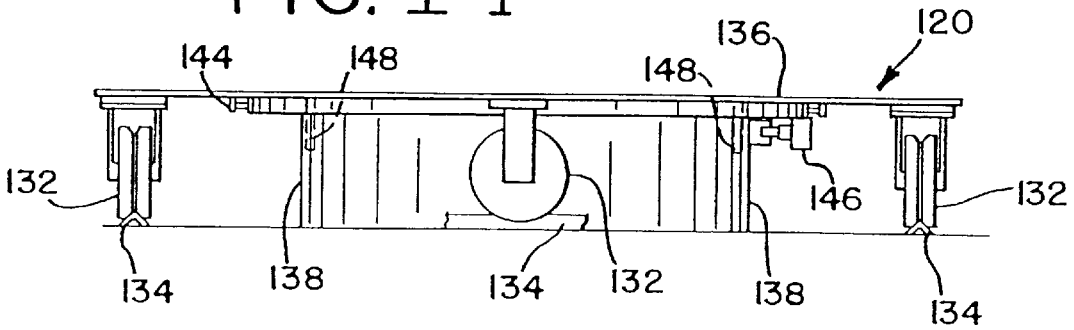
FIG. 14 is a side plan view of a rotating chamber base for use on the system of FIG. 12 for supporting a container.

A rotating base 120 is provided to spin the container within the chamber past the cryogen sprayers to provide 100 percent coverage of the container walls. The base 120 is preferably located outside of the insulated chamber 110 to minimize the friction and other problems, such as frozen parts, from exposure to cryogenic temperatures. The base includes a number of wheels 132 that follow along on a track 134, such as made from angle iron. As can be seen more readily in FIGS. 14 and 15, the base is made from a round annular support plate 136 upon which the container sits. A stationary pit skirt 138 is provided to surround the cryogen spray pit in the center of the base where cryogen is sprayed through a set of nozzles 140 in the bottom spray ring 142. The spray pit captures any liquid cryogen that has not expanded. An inner seal skirt 148 extends down from the inside circumference of the support plate 136. This rotating seal skirt 148 concentrically overlaps the inside of the stationary pit skirt 138 to help seal the cryogen in the pit space and keep the base 120 centered and on the tracks 134. Optionally, a compression seal or low temperature gasket (not shown) may be placed between the seal skirt 148 and pit skirt 138 to obtain a tighter seal of cryogen gas in the pit space below the container.

The base 120 is rotated by means of a chain/sprocket drive. Preferably, the chain 144 is located just below the support plate 136, outside of the pit skirt 138. A motor, gear reducer and chain drive (not shown) would fit in the annular space between the pit skirt 138 and the wheels 132. Other means of driving the base may be used, such as, but not limited to, worm drives, gear drives or belt drives. It is expected that the base would need to rotate about 8 to 12 r.p.m. depending on the types of residues needed to be cleaned. Several cam follower rollers 146 extend outward from the pit skirt 138 and support the rotating base plate 136. Thus, the weight of the base is supported on the outer portion by the wheels 132, and on the inner portion by the rollers 146.

As an alternative to a rotating base, a stationary base may be used. However, additional cryogen spray ports would be necessary around the complete perimeter of the container. Likewise, the chamber would need to be larger all around to provide adequate distance between the ports and container for sufficient dispersion of cryogen.

The container chamber 110 has an opening in the top sized to permit the container to extend through. Ideally, the amount of container extending above the chamber would be minimized to maintain low temperatures on all of the surfaces of the container. In cases where the container diameter is too small to be adequately sealed against the compression seals 130 located at this opening, adjustable collars (not shown) having seals may be placed on top of the chamber and positioned against the containers to seal the chamber.

The lid chamber 112 has a similar opening in the top to permit a lid 30 to be positioned upside down through the opening. The lid seals against the opening to keep the cold cryogen vapor inside the chamber when in use. With the lid upside down, the interior surface is exposed to the outside for cleaning. Inside this chamber, a cryogen spray ring 150 is provided with a plurality of spray nozzles 150 directed upward toward the lid. Optionally, a center spray nozzle 152 may be provided. The chamber shown is square, but any shape chamber would be adequate for cleaning the lid. Likewise, the chamber may be at any height suitable for a worker to easily reach over and scrape, brush or vacuum the frozen residue.

For either chamber, an insulated cover may be used to cover either the container or the lid while in the chamber to enhance low temperature penetration through the residue. In cases of very thick residue inside the container, it may be desirable to have a cryogen spray port inside the cover to spray cryogen directly against the residue inside the container or lid. Also, for small containers, such as drums and pails, the cover can be used to seal the chamber while the small containers are being cooled. However, the small containers would likely need to be removed for workers to clean them.

A work platform 154 may be provided to allow workers to stand above an open container in the chamber and clean it out. The work platform may extend to both the container chamber 110 and the lid chamber 112 when the lid chamber is moved to a higher position. A foot pedal 156 is shown on the platform. The foot pedal may be used to control the rotation of the base to permit workers to concentrate on specific parts of the container.

The arm/lift 114 that is used to remove the lid and place it in the lid chamber 112 may be hydraulically, pneumatically or mechanically actuated. The arm/lift shown is supported in a central housing 158 attached to the container chamber 110. Other means may be provided for moving the lid, such as, but not limited to, overhead crane, trolley or pulley systems.

A number of accessories may be used with the insulated chambers. These accessories include a brushes and scrapers to separate embrittled residue from the container surfaces. The brushes and scrapers may be on mechanical stations that lower the brushes and scrapers into the container to work against the residue as the container rotates on the base.

Also, a vacuum system may be used to remove the separated residue from the container. A water mist spray gun may be used to spray onto thin frozen residue in the container. The water freezes to the thin film of residue and builds up a thick layer that is easier to remove than the thin film of residue, alone. If sprayed before the residue were cold, then the water would accumulate and run down to the bottom of the container. Preferably, soft water is used because it has a lower surface tension and should penetrate better into most residues.

In addition, an air desiccant dehumidifier and air blower system may be used. Sometimes, the cold temperature of the container in the chamber causes a fog to form in the chamber from the warm, moist ambient air that may enter as workers attempt to clean the container. This ambient air may turn into a fog as it cools down. The cool dehumidified air blown into the container will eliminate this fog and permit clear visibility for cleaning the chamber.

The cryogenic cleaning system may be controlled by a computer system such as a programmable logic controller (PLC). The PLC may control the action and speed of the rotating base. The PLC may control the flow rate of cryogen sprayed into the chamber, and the location where the cryogen is sprayed. For example, the PLC may direct cryogen through high flow, medium flow, and low flow spray nozzles, depending on the temperatures in the chamber and the thickness of the residue in the container. Also, the PLC may direct cryogen independently to the sides, top or bottom of the container. A temperature sensor in the chamber can be used to monitor the amount of cryogen sprayed, as can an infra-red thermal sensor that can measure the temperature of the container surface. The PLC can also be used for automatic shutdown safety features. For example, if the doors are opened while cryogen is being sprayed, the spray will be shut off.

Alternative shaped boxes, enclosures and systems are within the contemplated scope of the present invention. For example, the chamber may be built square to be used with square IBCs. Likewise, a square or round chamber can have adjustable openings and seals to clean both square and round containers. Alternative chamber configurations may be readily designed by one skilled in the art based on the teachings described herein and the teachings and concepts disclosed in U.S. application Ser. No. 08/422,547, filed Apr. 12, 1995, and U.S. application Ser. No. 08/206,731, filed Mar. 7, 1994, now issued as U.S. Pat. No. 5,456,085 to James Popp and Carolyn Popp, the contents of both applications of which are incorporated herein by reference. Also, the teachings in these applications provide additional understanding to one skilled in the art to better appreciate the preferred methods for cryogenically cleaning containers or for using cryogenic cleanings systems, such as described above. However, the teachings in these applications are not necessary for one skilled in the art to understand and practice the invention in all its embodiments of which the preferred embodiments are described herein.

A preferred embodiment of the method of the present invention may be most expeditiously described by reference to the afore-mentioned preferred embodiment of the apparatus. A container 20 may be cleaned cryogenically by placing the container, having residue adhered to its surface, into an insulated box 110, removing the lid 30 with the arm/lift and placing it in the lid chamber 112. The container can be placed in the chamber by opening the doors 118 and having a fork lift bring the container through the door opening and setting the container on top of the base 28. Then, the doors are closed and cold cryogen, such as from a container of liquid nitrogen, is sprayed into the insulated chamber 110 such that it contacts and cools the container body 22 and residue. The rotating base is preferably switched on before spraying so the container may be completely covered with cryogen and evenly applied to avoid thermal shock. The residue will become embrittled and fragment and may be separated from the surface by scraping or brushing the residue off the surface of the container body. In some situations, the container may need to be impacted or vibrated to loosen strongly adhering residue. The residue is then removed from the container through a vacuum hose into a residue receptacle leaving a substantially residue-free container. After the residue is removed, the container is removed from the insulated box 110.

A liquid cryogen is preferably used, such as liquid nitrogen at 22 psig, and is introduced into the open space between the walls and the container. A cryogen pump can be used to maintain 22 psig in the supply line. As liquid nitrogen enters into this area and comes into contact with the warm air and the warm IBC, the liquid nitrogen expands into a gas and lowers the temperature of the interior of the equipment and the IBC itself to temperatures as low as minus 300° F. The exact temperature and the amount of time required is based on the type and amount of residue being removed from the IBC. The thermal dynamic reaction between the contraction of the metal IBC and the expansion of the residue material being removed results in the bond being broken between the IBC and the residue. The frozen residue can then be scraped, brushed and/or impacted and removed by shoveling and/or vacuuming the embrittled and disbanded residue. There are some residues that may only require shoveling or vacuuming without any scraping, brushing or impacting. The container, if light enough, can also be removed and turned upside down for removal of the embrittled and disbanded residue, although this is not the preferred method.

The present invention may be applied to clean a wide variety of residues of expended commodities from commodity containers. These residues include, but are not limited to tars, lubricants, mastics, inks, coatings, solvents, adhesives, glues, sealants, varnishes, paints, paint pigments, enamels, resins, plasticized materials, greases, cementations materials, etc. The residues may also be consumable, that is, food product commodities such as molasses, honey, corn syrup, apple syrup and the like. The present invention may be applied to containers having a combination of different residues adhered to its surface. The residues may be fresh, that is, in their commonly useful form, liquid, viscous, or tacky. Also, the residues may have a dried surface film. Moreover, the present invention may be applied to residues that have become dried, solidified or baked-on. Generally, the present invention works quickly with residues that thinly coat the surface of the container, but also is effective where the residue is several inches thick, or greater. Typically, the present invention is directed towards cleaning the inside surfaces of containers, but, as will become apparent from this detailed description, can also clean the outside surfaces.

The present invention may be applied to commodity containers made from metal, plastic, polymers, resins or a composite of different materials. For example, some residue can become embrittled at temperatures of only −50° F. (−50° C.), while plastic containers made from HDPE need to be cooled to −250° F. (−155° C.) to become embrittled to the point where the container may be permanently damaged. The present invention may substantially remove the residue from the container so that the container may be re-used, meet government requirements for non-hazardous waste disposal, or be further cooled to the point of embrittlement so that the containers may be crushed to reduce its volume for disposal. The containers preferably range in size between about 85 gallons and about 350 gallons. The method of the preferred embodiment is particularly well suited for commonly used intermediate bulk containers 270 to 350 gallons in volume. Most preferably, the containers have a substantially cylindrical shape with a full opening at one end. The residue may be removed easiest from such a container, but the present invention may be effective on other containers, such as those having tight corners and a small opening.

Cryogens are generally gases that have a very low boiling point. Nitrogen ($N_2$), for example, has a boiling point of −320° F. (−195° C.) at atmospheric pressure. The cryogens may be readily stored as a liquid in specially designed storage tanks. A range of liquid cryogens, or cryogenic agents, or cryogenic gases are commercially available that theoretically could be used with the present invention. These include, but are not limited to, Nitrogen, Helium, Argon, and Carbon Dioxide. However, some cryogenic gases are flammable or require extreme precautions and equipment to be safely used, and are therefor not preferred. Nitrogen is a preferred cryogen because of its relative safety in use and low cost. Nitrogen is an inert gas that is not flammable, is non-toxic and does not raise a risk of reaction with residue or equipment materials. Nitrogen is the largest constituent of air so it can safely dissipate into the environment. Special safety equipment is not required when using Nitrogen cryogen with the present invention, other than minor protective gear for the cold temperatures. However, a large, well ventilated room is preferred for using the present invention to avoid Oxygen deprivation due to the vaporized Nitrogen cryogen displacing the air from the room.

The cooling time and operating temperature are interdependent. The residue is not required to cool to the selected operating temperature. Rather, the lower temperatures will result in faster heat transfer rates and reduce the amount of time required to embrittle the residue. Thus, economic trade-offs are involved in the selection of the operating temperature. Lower temperatures and shorter cooling times will require the use of more cryogen. On the other hand, higher temperatures and longer cooling times will correspondingly increase labor costs.

Subject to the foregoing, for most applications, lower temperatures and faster cooling times are preferred. This can be accomplished by introducing sufficient cold vaporized cryogen into the insulated box 10 with a container inside to maintain a temperature of between about −100° F. (−75° C.) and about −300° F. (−185° C.). Preferably, the temperature will be maintained between about −150° F. (−100° C.) and about −250° F. (−155° C.).

During the cooling step, as the temperature in the box rises above its desired value, more cryogen should be introduced to lower the temperature back to the desired value. This may be accomplished by using an automatic temperature controller or a PLC for regulating a cryogenic control valve. Maintaining the internal environment of the insulated box within the most preferred temperature range for a period of about 4 to about 6 minutes will sufficiently embrittle thin coatings of most residues. Of course, this time may vary depending on several factors. Thick layers of residue will require more cooling time. For example, a six inch layer of a coating material may require up to about 15 to 20 minutes of treatment time.

In some situations, for example when the residue is difficult to remove, the container may be thermally cycled. The container may be cooled, then warmed, and then cooled again. It is believed that the different rates of contraction and expansion of the residue and container may cause the residue to release from the container surface over successive temperature cycling. In this vein, it may be desirable to apply steam to the residue to warm it up faster than the container, thus exaggerating the temperature differences. Likewise it is believed that the moisture from the steam may get between the residue and container surface, which upon cooling, will freeze, expand and pop the residue off of the container surface.

For certain residues, the use of a mold release agent may be desirable. For example, paint used for painting stripes on highways is made to adhere to the road surface in a range of weather extremes. This property also makes it particularly difficult to remove from containers, even using cryogenic temperatures. It has been found that this road surface paint can more easily be removed from the containers if a mold release agent is sprayed onto the clean container interior surface before the paint is loaded in the container. Even highly polished container surfaces may have micro-sized pores in the surface that residue may tenaciously adhere to. It is believed that the mold release agent fills in these pores to prevent the residue from penetrating and attaching to the container. The agent is typically sprayed onto the clean surface and allowed to dry into a thin 1–2 micron layer that resists mixing with the commodity material loaded into the container. The release agent should be specially formulated for the particular commodity to be transported in the container. Chemlease International, Inc., of Lake Mary, Florida USA has commercially available such mold release agents and may specially formulate agents for a wide variety of commodities and container materials.

In some situations, such as when the residue is a thin layer, it may be difficult to efficiently remove all the residue. One reason for this may be that the thin residue does not have sufficient mass and internal strength to separate from the container in large fragments. This may be analogized to the removal of ice from an automobile windshield, i.e., comparing removing a layer of frost and a thick sheet of ice. This situation may occur for thin residues, such as less than ¼" thick.

To improve the efficiency of the above-described method, a thermal-retentive mass may be adhered to the residue before the residue is cryogenically embrittled. By "thermal-retentive mass" it is meant a mass or bulk of material sufficient to retain the cold embrittlement temperatures for a sufficient period of time after the container has been removed from the cryogenic environment so that the residue remains embrittled and can be fragmented by impacting the container. In addition, it is believed that the weight from the adhered thermal-retentive mass also helps separate the residue from the container surface, either through scraping, brushing, impacting or vibrating. Also, it is expected that a thermal mass with a high heat transfer rate may increase the speed with which the residue cools down.

This thermal mass may be a granular material with a size between about 0.05 and 0.35 inches. When the residue is a consumable food product, it may be preferable to use a consumable thermal mass so that the residue and thermal mass can be recycled together as an animal food product. Some of these granular materials may be, but are not limited to, salt, sugar, sand, corn granulars, bean granulars, aluminum oxide, clay pellets, "oil-dri" oil absorbent pellets, rubber granulars, plastic granulars, chopped fibers, wood chips, rock chips, slag from steel making, cork granulars, metal granulars, leather granulars, glass granulars or coal granulars.

The choice of which granular to use with which residue may depend on many factors including the cost, the use to be made of the residue afterward, the compatibility or inertness of the granular to the residue, the adhereability of the granular to the residue, disposal restrictions, etc. For example, an "oil-dry" adsorbent granular was effective in assisting the removal of a thin layer of resin adhesive from a cylindrical pail.

The granulars may be applied by hand, sprayed on, rolled on, applied before the container is placed in the cryogenic treatment enclosure, applied inside the enclosure, or applied simultaneously with the injection of cryogen. The granulars adhere most readily to residue that is wet, tacky or viscous. It is possible that the granulars be mixed with a resin, or other material, so that it could adhere to dry residues. Also, the granulars could be mixed with a liquid and sprayed onto frozen residue.

Beside a granular form, the thermal-retentive mass may also be fibrous or viscous. The fibrous mass can adhere to the residue to form a membrane, or matting. The fibers may be pulled away from the container and pull the embrittled residue with it. Such fibrous mass may include fiberglass strands or fabric, cloth threads, polyester threads, wood shavings, cheese cloth or fabric scraps, for example.

A viscous thermal mass may also be used. For example, molasses, resin or mastic can be applied to the residue to build up its layer to a critical mass sufficient to retain its embrittlement after removal from the cryogenic treatment enclosure. Even when the residue is in a dry form, a viscous or tacky material can be readily adhered to form a thick heavy thermal-retentive layer on the container surface that can be easily treated according to the method of the present invention. Other materials, such as water, gels or foams, may also find use in this application.

The advantages of the preferred embodiments are numerous. The preferred embodiments avoid the use of solvents and other wash liquids associated with traditional cleaning methods so that the amount of hazardous material for disposal is limited to the original residue itself. Moreover, the residue may be recycled or re-used since it is not contaminated by wash liquids or solvents.

The described methods require less equipment and less labor to operate than traditional methods of cleaning and reduces health risks to the employee. The described methods are more economical than traditional cleaning methods. The preferred embodiments substantially remove the residues from the container to meet government disposal requirements and industry requirements for re-use or recycle of the container.

It should be appreciated that the methods and apparatus of the present invention are capable of being incorporated in the form of a variety of embodiments, only a few of which have been illustrated and described above. The invention may be embodied in other forms without departing from its spirit or essential characteristics. For example, the container may be a composite made with a plastic or fiberglass outer shell and a metal liner. The metal liner could be removed and easily cryogenically cleaned. The fiberglass and plastic type container would be lighter weight and less expensive than a full metal container. Also, fiberglass and plastic containers do not have as stringent tests to pass as have metal tanks.

The described embodiments are to be considered in all respects only as illustrative and not restrictive, and the scope of the invention is, therefore, indicated by the appended claims rather than by the foregoing description. All changes which come within the meaning and range of equivalency of the claims are to be embraced within their scope.

We claim:

1. A method for cleaning residue of expended commodity from commodity containers comprising the steps of:

(a) cooling the container and the residue to effect substantial embrittlement of the residue adhered to the surface of the container;

(b) fragmenting the embrittled residue;

(c) separating residue fragments from the surface of the container; and (d) removing residue from the container.

2. The method according to claim 1 wherein the residue is removed by vacuuming.

3. The method according to claim 1 wherein the residue is separated by at least one of scraping and brushing.

4. The method according to claim 1 further comprising the step of placing the container in an insulated chamber with an opening in the top of the chamber and separating residue from the container with the container inside the chamber.

5. The method according to claim 4 further comprising the step of positioning a collar the top of the container to seal a gap between the container and the perimeter of the opening.

6. The method according to claim 4 wherein the perimeter of the opening seals against the container.

7. The method according to claim 6 wherein the container has a lip that extends outward from the container, the method further comprising the step of positioning the container such that the lip extends proximate to and contacts the perimeter of the opening to seal the opening.

8. The method according to claim 4 further comprising the steps of removing the container lid, placing a cover over the container and spraying cryogen into the interior of the container.

9. The method according to claim 4 further comprising the step of removing the container lid, spraying water into the interior of the container, freezing the water to the residue to build up the thickness of the material adhering to the container, separating the water and residue from the surface of the container and removing the water and residue therefrom.

10. An apparatus for cryogenically treating containers comprising an insulated box having an opening in the top of the box sufficiently large to allow placement and removal of a container therethrough, a collar adapted to surround a container placed through the opening wherein the collar has a width that extends from the exterior of the container to the perimeter of the opening to seal the opening, and a plurality of cryogen spray ports in the box.

11. The apparatus of claim 10 wherein the collar is slidably disposed on a top surface of the insulated box, the collar is comprised of a plurality of sections that have a flexible gasket on the interior face to form a seal against the container when positioned against the container.

12. The apparatus of claim 10 further comprising a second opening in the top of the box sufficiently large to allow placement and removal of a container lid therethrough and a door to seal closed the second opening.

13. An apparatus for cryogenically treating containers comprising a first insulated chamber having an opening in the top of the chamber sufficiently large to allow a container to extend therethrough, the opening having a gasket to seal against a container, the chamber further having a door on the side to allow placement of a container therethrough, a base for supporting a container, and a plurality of cryogen spray ports in the chamber, wherein the spray ports are located on the chamber wall across at least a third of the perimeter of the chamber spaced apart to spray the height of a container in the chamber, and located above the base to spray the bottom of a container.

14. The chamber of claim 13 wherein the base rotates enabling a container sitting thereon to turn past the spray ports located on the chamber wall.

15. The apparatus of claim 14 further comprising retractable scrapers adapted to scrape interior of container as it rotates.

16. The apparatus of claim 14 further comprising a work platform proximate to the top of the first chamber, wherein the work platform has a switch to control the rotating base.

17. The chamber of claim 13 wherein the opening has an adjustable collar that slides to position the gasket against the container.

18. The apparatus of claim 13 further comprising a second chamber adapted for receiving a lid of a container placed in the first chamber, and a lifting arm for removing and replacing the lid from the container and placing the lid in the second chamber.

19. The apparatus of claim 13 further comprising a vacuum system with nozzles adapted to remove residue from interior of container within the first chamber.

20. The apparatus of claim 13 further comprising a dehumidifier and air blower system positioned to place dehumidified air in the interior of a container within the first chamber.

* * * * *